US005813065A

United States Patent [19]

Tinhorn

[11] Patent Number: 5,813,065

[45] Date of Patent: Sep. 29, 1998

[54] CONTOUR SHAPED THERAPEUTIC PILLOW

[76] Inventor: Petra C. Tinhorn, 535 Oaks Dr.- Apt. 502, Pompano Bch, Fla. 33069

[21] Appl. No.: 418,021

[22] Filed: Jun. 9, 1995

[51] Int. Cl.[6] ..... A47C 20/02

[52] U.S. Cl. ..... 5/639; 5/636; 5/904; 5/637

[58] Field of Search ..... 5/636, 637, 904; 294/284.6, 217.1, 217.3, 217.4

[56] References Cited

U.S. PATENT DOCUMENTS

| | | | |
|---|---|---|---|
| 2,667,802 | 2/1954 | Harris | 84/95 |
| 2,780,693 | 2/1957 | McClellan | 200/86 |
| 2,940,088 | 6/1960 | Boos | 5/636 |
| 4,136,685 | 1/1979 | Ramey | 128/33 |
| 4,218,792 | 8/1980 | Kogan | 5/636 |
| 4,228,793 | 10/1980 | Ramey | 128/33 |
| 4,447,922 | 5/1984 | Brochu | 5/637 |
| 4,523,588 | 6/1985 | Dolsky | 128/201.25 |
| 4,538,142 | 8/1985 | Hamilton et al. | 297/217.4 |
| 4,773,107 | 9/1988 | Josefek | 5/636 |
| 4,862,438 | 8/1989 | Fry | 5/636 |
| 5,383,711 | 1/1995 | Houghteling | 5/63 |
| 5,392,478 | 2/1995 | Johenning | 5/462 |

*Primary Examiner*—Steven N. Meyers
*Assistant Examiner*—Tuyet-Phuong Pham
*Attorney, Agent, or Firm*—John Halvonik

[57] ABSTRACT

The invention is a music-playing pillow with an internal music playing device. The device has a switch for automatically turning the music on when pressure is applied and turns off when pressure is removed. The pillow has an ovoid shaped depression for the head, consisting of tightly bound cotton material in the interior, which will be elevated on all sides, and up to the cheek bone area, with an elevated portion for the neck to give it warmth, protection and support. The bottom portion of the pillow will end into a "c" shaped curve which will come to either side of the upper trapezius and will support the three basic neck muscles.

4 Claims, 3 Drawing Sheets

CONTOUR SHAPED THERAPEUTIC PILLOW

BACKGROUND AND FIELD OF THE INVENTION

The invention relates to the field of pillows and, in particular, to a pillow that provides a musical sound to accompany the user as he or she rest and/or falls asleep. It is believed that a pillow that can simultaneously provide the feelings of warmth, sound, and touch to the user will provide a relaxed feeling and allow them to rest or fall asleep peacefully.

The pillow is also shaped to accommodate the size and contour of the user's head so that the pillow molds up to the sides of the face, up to the cheek bone area. The shape varies in proportion to the shape and size of user's head and neck. The neck area of the pillow is elevated in relation to the head portion of the pillow. It is believed that that by supporting the neck and head with the the pillow this will help prevent snoring and early morning "Dry Mouth" feeling, it is also believed to prevent the addition of sleep wrinkles of the face.

PRIOR ART

While there are pillows that do have sound-emitting capabilities, none that applicant is aware of that provide music upon the weight of the user (head or neck) being applied to the pillow and that deactivates the music when the weight is removed from the pillow. In addition, it is believed that the use of a pillow with heat reflective properties is novel with respect to such pillows.

In addition, the use of the particular shape of applicant's pillow is also believed to be unique in the sense that the head molds into the pillow and the pillow is designed in such a way that there is no excessive pressure put on the face of user which prevents the formation of early wrinkles. The elevated support under the neck is also believed to help prevent snoring because it helps keep air passage of the neck (trachea) open.

SUMMARY OF THE INVENTION

The invention is a music-emitting pillow with an oval shaped depression to accommodate the shape of the user's head. The depression is deep enough to partially enclose the user's head when he/she lays their head on the pillow and the top of the pillow should come up to about the top of the cheek bone area of the person. The base of the depression will be elevated so that the neck will be supported and protected from any undue strain.

Inside the pillow is a music emitting device having a weight-activated means for playing music when weight e.g. that of the user's head is placed on the pillow. The music emitting device has a timing means which allows the music to play for a predetermined time, say 30–60 minutes. The weight activated means has a means for turning off the music before the predetermined time in the event that the weight is lifted off the pillow and has a means for restarting the music when the weight is returned. The pillow may be filled with e.g. foam rubber, tightly bound cotton, etc. in order to provide a firm, supporting pillow. The pillow may be covered with a heat reflective material, e.g. mylar for cold weather, illness etc., or with cotton for warmer temperatures.

It is among the objects of the invention to provide a pillow to encourage the user to relax or fall asleep by providing stimulation of the senses of hearing and touch through the use of music as well as heat reflective properties of the surface of the pillow.

Another objective is to provide a pillow that will keep the user's head at a 35–45 degree angle, with respect to the bed, so that the pillow will keep the users' face and neck free from pressure and thus help to prevent early, unsightly, wrinkles to both face and chest.

Another objective is to provide a pillow that can reflect the heat of the neck and provide comfort to the user.

Another objective is to provide a music emitting pillow with a sound emitting device that is constructed on the inside of the pillow in order to avoid the need for speakers on the outside of the pillow which may lead to the discomfort of the user.

Another objective is to provide a music emitting pillow that will emit music when a person's head/neck is laid on the pillow and will stop the music and rewind in response to the head/neck being removed from the pillow in order to restart music.

Another objective is to provide a therapeutic pillow which will enhance muscular relaxation during rest/sleep as well as minimize sagging skin.

Another objective is to provide a pillow with a specially designed protrusion in the pillow that will support the neck of the user and keep the airway in the neck open which should help prevent snoring and prevent discomfort due to arthritis or drafts.

Another objective is to provide a pillow that can support both the neck and head of the user in an upright position with little pressure on the face and thus prevent, or mitigate, the formation of wrinkles in the face during sleep.

Another objective is to provide a pillow that will alleviate stress on the neck and thus reduce the possibility of stiffening of the neck during sleep.

Other objectives of the invention will be readily apparent to those skilled in the art once the invention has been described.

DESCRIPTION OF THE PREFERRED EMBODIMENT

Figure 1:
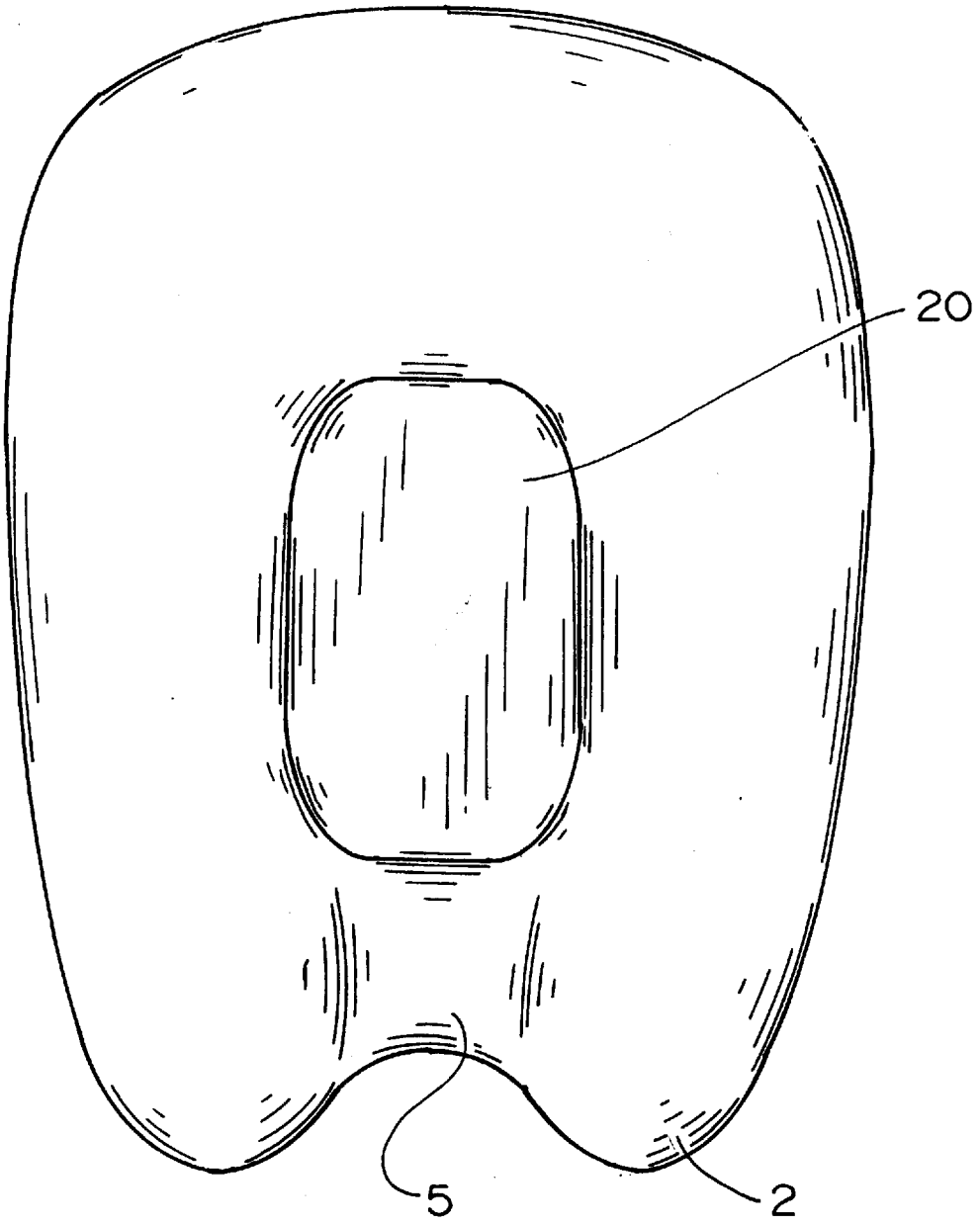
FIG. 1 is a top view of the pillow.
Figure 3:
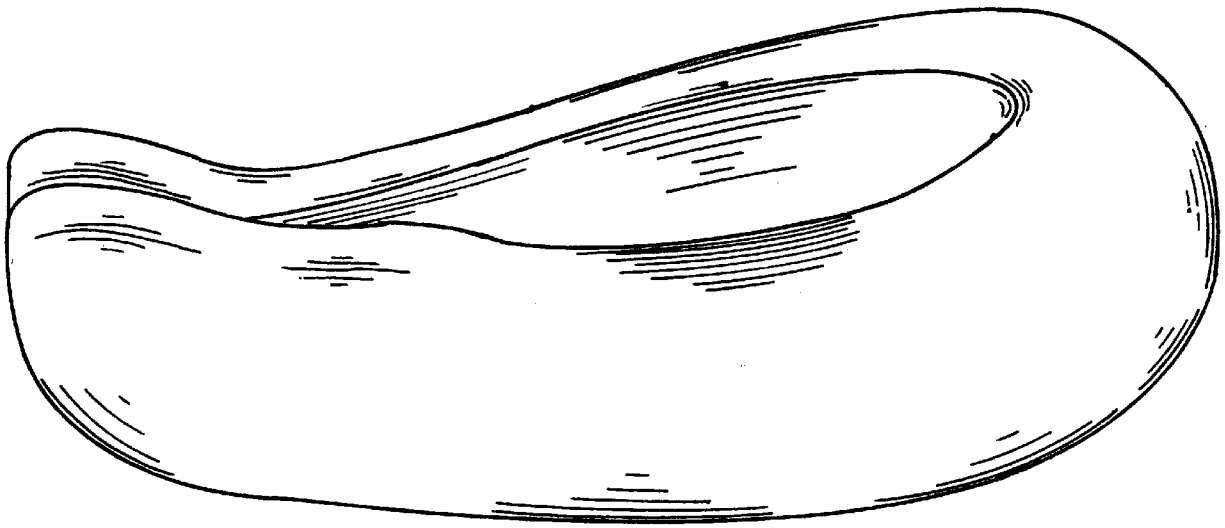
FIG. 3 is a side view of the pillow.
Figure 2:
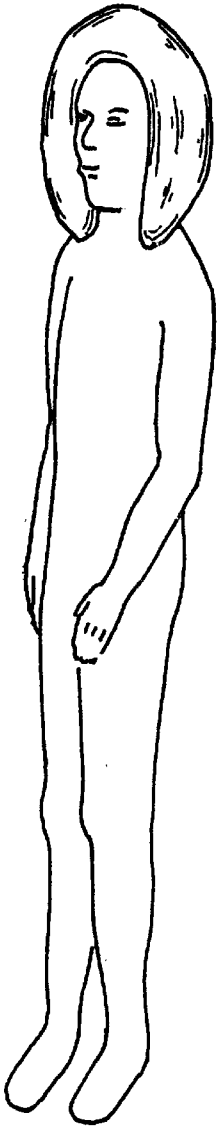
FIG. 2 is a side view of the pillow and user.

The overall construction of the pillow is as shown in FIG. 1. The pillow should have an outer layer (made of materials e.g. mylar, cloth, etc.) which may be filled with typical cushioning materials found in state of the art pillows such as: cotton, foam, feathers, synthetic materials, etc. in order to produce the overall shape of the pillow.

The inside of the pillow has a music emitting device 8 that has a means for emitting music in response to a weight (such as the user's head/neck) being laid on the pillow. The music emitting device will likely have a tape cassette storage medium for the music. The music emtting device should be in connection with a timing means so that the music will be shut off after a predetermined time, say, 30 or 60 minutes.

The music emitting device will also have a means for turning off and rewinding (in the case of tape cassettes) the music, in response to the weight being removed from the pillow before the predetermined time expires. Again, this may be done by the sensor 10 sending a signal to the music emitter. When the user returns to the pillow, the weight of the neck or head will again activate the music through the sensor.

The music chosen for the pillow should be very relaxing soothing music. Such relaxing music may include by way of example, "New Age" music produced by Valley of the Sun Studios located in Malibu, Calif. 90265. Typical New Age Music includes such examples as: "Upper Astral Suite", which is metaphysical music; "Dawning of the New Age", by Davis Naegele; "Crystal Cave," etc. It is believed that such sounds will relax the mind, body, and soul.

Such a musical device would cover those situations where the user may get up, say, to go to the bathroom, and the music can then begin again when the user puts his head back on the pillow. The weight-sensor in the music emitting device may be nothing more than a unit that sends a signal to the music emitting device in the event that a weight is placed on the pillow or is removed. The music emitter would then operate in an on/off mode where each successive signal changes the mode. The music emitting device can have a switch or sensor 10 that will turn the music off and on when such a signal is sent to it.

In the event that the user gets up the music will turn off in response to the signal sent from the sensor. When the user returns, the signal sent to the music emitter will the activate the music again. In addition, there should also be a means to rewind (in the case of tape cassette storage medium) the recorded music back to start when the music has finished playing.

The overall shape of the pillow is shown in FIG. 1. There is an oval depresssion 20, the bottom 9 of which suports the back of the head. The depression is surrounded for the most part by a head wall 6 that should come up the temple area 12 of the user. At that area where there is no head wall there is an elevated neck channel 5 in connection with the oval depression and is shaped to support the neck 2.

The contour of the pillow helps alleviate pressure on the face as the walls 6 are elevated so that they extend to both sides of the face and head up to the top of the cheek bone 12, arrow I shows the height of the wall in relation to the bottom of the pillow. The wall is, in proportion to user's head as the sides of the user's head are supported during sleep.

The special countour of the pillow provides depressions in the pillow for the support of the head of the user. The depression 20 is preferably oval shaped (or nearly so) and conforms to the shape of the user's head. The neck channel 5 is somewhat raised in relation to the bottom 9 of the oval depression thus giving the neck support and therapeutic stimulation.

Figure 4:
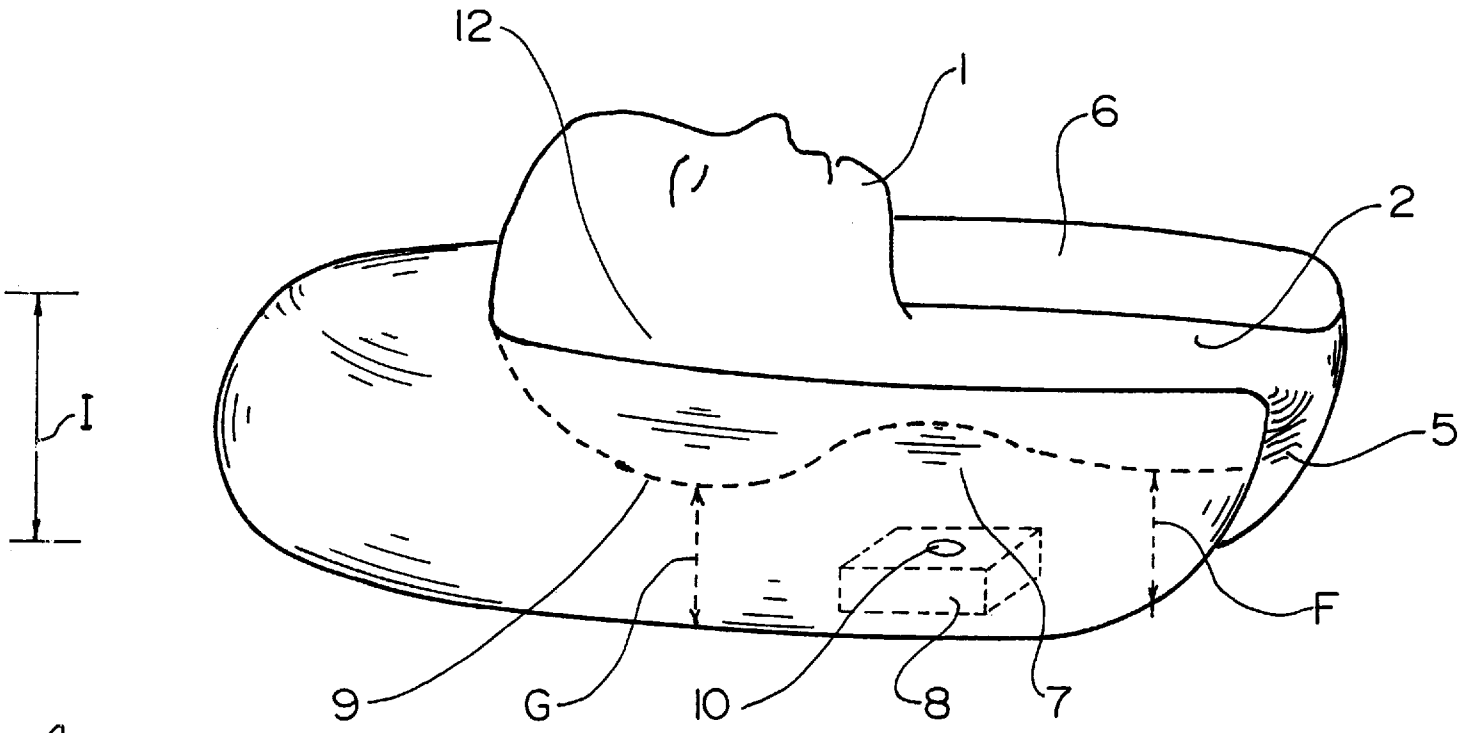
FIG. 4 shows a cross section of the pillow in use.

Note in FIG. 4 that arrow F shows the height of the bottom 7 of the neck channel in relation to the bottom of the pillow, while arrow G shows the height from the bottom 9 of the oval (head support) depresion to the bottom of the pillow. Height F should be greater than height G. Thus the thickness of the bottom of the pillow at G is about 1–8" and the length of the raised up portion 7 (along line B) should be about ½–4".

The neck channel (5) is thus elevated in relation to the head depression and will support the upper trapezius muscle at the back of the neck in order to accommodate the position of the neck 2. The width of the neck channel should be about 2–6½". The neck will thus be slightly above that of the head when the user lays his/her head in the pillow, face up.

The width of the walls shown as line C should be about 4" and the height shown as line I should be about 6–12".

These depressions 20 and 5 will thus engulf a large portion of the person's head and neck and thus provide a support that will prevent or hinder the user from moving the head and neck. It is preferred that the head depression will be deep enough so that the top of the side walls of this depression will come up to the front of the user's cheek bones and/or the temple area 12. It is believed that this will alleviate stiff necks and snoring. It is believed that many commonly found pillows do not support the neck and this may lead to stiffness of the neck when the user awakes.

The pillow may be covered with a heat reflective covering 30 such as, mylar, for example, that would reflect the body heat of the user and so provide a warming feeling to the head and neck of the user. A heat reflective pillow is believed to provide additional comfort to those with arthritis of the neck which may help to ease the pain. The neck and head depressions will conform around those parts of the user and thus keep a large part of the neck and head out of direct exposure to the air. This is believed to keep the head and neck warm in the event of sweating and/or drafts.

The dimensions of the pillow will vary depending on the user, there may be adult, child and infant sizes of pillows. The depth of the depressions in the pillow may vary. The cushioning material on the inside of the pillow should conform to the shape and size of head and neck, and coming up to the level of the face by the temple area.

The mylar covering may be used in the winter or during times of illness or stress, and there may be a covering of cotton for the summer. The therapeutic pillow, should enhance muscular relaxation during rest/sleep as well as minimize sagging skin because the pillow is shaped in such a way that the head and neck will always be in a 35 to 45 degree angle in relation to the bed (or whatever surface the user is sleeping upon) which keeps the air passages open and may thus prevent snoring.

The pillow should support the head in one position which helps keep ones' skin smooth and relaxed, but not to the point of causing early wrinkles. The support on the neck helps relieve tension and sore necks and will help to keep the air passage open to breath normally.

When an individual is sleeping/resting, the facial muscles and skin relax which may lead to wrinkles during sleep due to pressure on either side of the face. This pillow described herein is designed to prevent that as well as alleviate snoring, temporary blockage of the air passage causes snoring, and dry mouth, the pillow keeps air passage free for normal breathing. The pillow supports the head in a manner that keeps the skin of the head and neck firm without constricting the blood vessels and muscles of the neck and face. The support of the face and neck will also place the skin in a position to be well ventilated during sleep.

I claim:

1. A music emitting pillow for supporting the head and neck of a user prior to the onset of sleep and for turning off and on music in response to the lifting up of the user's head, said pillow comprising: a pillow having a music producing means; a pressure activated switch in connection with said music producing means for turning off and on said music in response to changes in pressure upon said switch, said pillow having a neck support channel of size adapted to enclose the neck of the user on three sides and limit the movements of the user's head and neck, a head depression in connection with said neck channel, said head depression of size adapted to support the back of the user's head, said pressure activated switch in connection with said head depression so as to turn off and on said music in response to changes in pressure upon said head depression.

2. The pillow of claim 1 wherein said music emitting means has a timer for limiting the length of time said music is emitted to a predetermined amount of time.

3. The pillow of claim 2 wherein said pillow has an outer covering made of a heat reflective material.

4. The apparatus of claim 3 wherein said head depression has a bottom surface and an oval shaped side surface, and said neck channel has a bottom surface and at least two side surfaces, wherein said bottom surface of said neck channel is of a height in relation to said bottom surface of said head depression so as to support the user's neck at a position higher than back of the user's head.

* * * * *